United States Patent [19]

Jonker

[11] Patent Number: 4,867,320

[45] Date of Patent: Sep. 19, 1989

[54] CONNECTING STRUCTURE FOR PANELS INTENDED FOR USE IN A STORAGE AND/OR DISPLAY DEVICE

[76] Inventor: Robert G. C. Jonker, 24, Toernooiveld, 4902 PH Oosterhout, Netherlands

[21] Appl. No.: 246,934

[22] Filed: Sep. 19, 1988

Related U.S. Application Data

[63] Continuation of Ser. No. 29,902, Mar. 17, 1987, abandoned.

[30] Foreign Application Priority Data

Mar. 25, 1986 [NL] Netherlands ..... 8600767

[51] Int. Cl.[4] ..... A47B 47/00

[52] U.S. Cl. ..... 211/189; 211/198

[58] Field of Search ..... 211/189, 182, 183, 194, 211/198; 312/111; 248/297.2; 403/254, 381; 160/135

[56] References Cited

U.S. PATENT DOCUMENTS

| | | | |
|---|---|---|---|
| 2,145,030 | 1/1939 | Press | 160/135 X |
| 3,463,218 | 8/1969 | Cannon et al. | 160/135 |
| 3,528,559 | 9/1970 | Miller | 211/182 X |
| 3,565,152 | 2/1971 | Cohn, Jr. | 160/135 |
| 3,889,736 | 6/1975 | Firks | 160/135 |
| 4,094,417 | 6/1978 | Cairnes et al. | 211/183 |
| 4,334,571 | 6/1982 | Heller et al. | 160/135 |
| 4,434,900 | 3/1984 | Cook | 211/189 |
| 4,556,148 | 12/1985 | Koller | 211/182 X |

*Primary Examiner*—Sarah A. Lechok

*Attorney, Agent, or Firm*—John P. Snyder

[57] ABSTRACT

This invention relates to a connecting structure for panels intended for use in a storage and/or display device for objects of an arbitrary nature, such as books, clothing etc., consisting substantially of adjacent compartments separated by load bearing units.

7 Claims, 2 Drawing Sheets

FIG.1
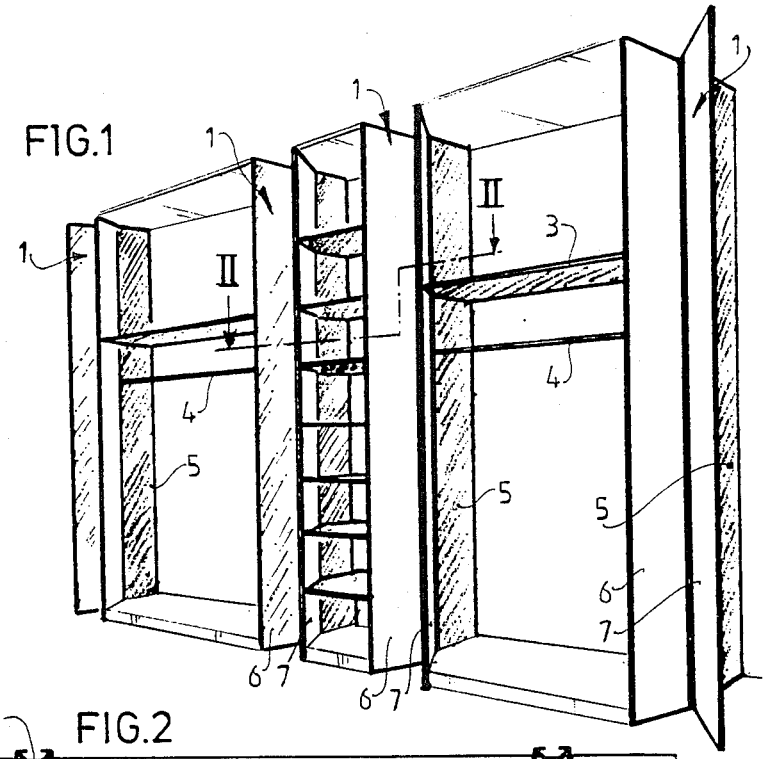
FIG.2
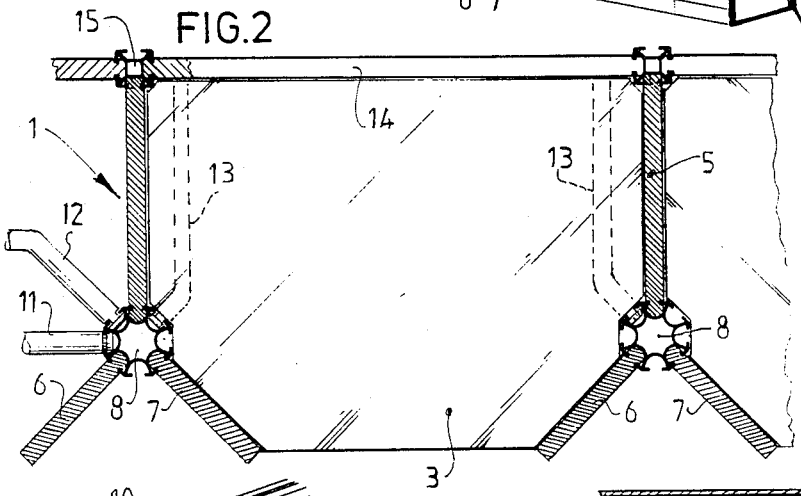
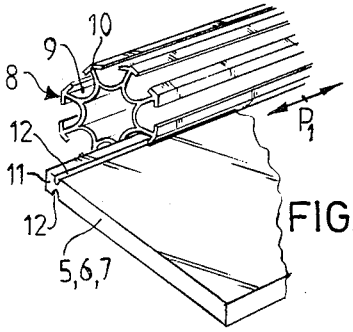
FIG.3
FIG.4
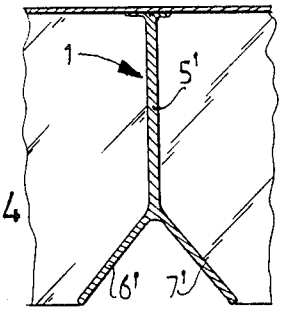

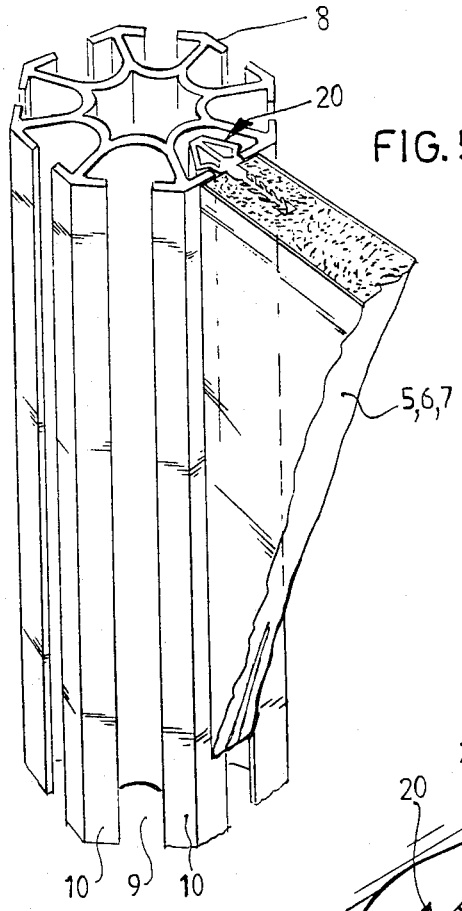
FIG. 5
FIG. 6
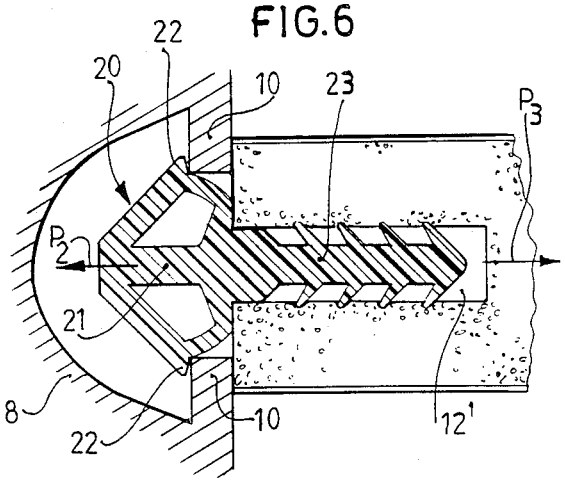

CONNECTING STRUCTURE FOR PANELS INTENDED FOR USE IN A STORAGE AND/OR DISPLAY DEVICE

This application in a continuation of application Ser. No. 029,902, filed Mar. 17, 1987, now abandoned.

This invention relates to a connecting structure for panels intended for use in a storage and/or display device for objects of an arbitrary nature, such as books, clothing etc., said device consisting substantially of adjacent compartments separated by load-bearing panel units.

The invention has for its aim a connecting structure whereby the use of backing panels in order to prevent the display case from collapsing is restricted to a minimum, so that the assembly of the device is simplified and the number of components, and thus the cost, is considerably reduced.

The structure according to the invention is distinguished in that the mutually facing edges of at least two upright panel strips are connected together, such that the panels are forming an angle, in order to obtain a self-standing panel unit.

Owing to the self-standing property of the panel units, these can be set up at a distance from one another with practically no cross-bracing, in such manner that the shelves or other supports for respectively the storage or display of articles can be suspended between them.

In the preferred embodiment three panel strips, one of which is wider than the other two, are connected together for each upright panel unit. This arrangement gives the device an unusual and unexpected appearance.

For a simple way of assembling the invention proposes a connecting moulding which extends over the full length of the panel strips. Each panel strip is hereby provided with two grooves arranged in the side surfaces, in which the long edges of an undercut channel of the moulding are accomodated.

According to another embodiment the edge of a panel is provided with one or more connecting member spaced along its length, said member being permanently fixed to said panel edge and having a flexible body to be inserted in said longitudinal undercut channel of said mould.

Finally, according to the invention the moulding is provided with extra longitudinal channels for the attachment of accessories such as shelf-brackets, rails for hangers and the like.

The invention will be further explained in the detailed description, below, of several embodiments.

In the drawing:

FIG. 1 shows a perspective front view of the device according to the invention,

FIG. 2 shows a horizontal transverse section according to the line II—II in FIG. 1, FIG. 3 shows a detail of the connecting structure provided with a panel strip and a connecting moulding from FIG. 2, FIG. 4 shows a cross-section corresponding to FIG. 2 of an alternative embodiment of the structure FIG. 5 shows a perspective front view of another embodiment of the connecting structure, comprising a mould and a panel strip provided with a connecting member.

FIG. 6 is a cross-section of said mould and panel in FIG. 5.

The device shown in FIG. 1 consists of standing panel units 1 which are arranged at a distance from one another so as to form arbitrary width compartments 2, in which shelves 3 or hangers 4 can be installed for the respective storage or display arbitrary articles.

According to the invention, each standing panel unit 1 comprises panel strips 5, 6, and 7, each of which forms a non-180° angle with respect to each other, so that each panel unit can remain standing upright of its own accord. It can be seen in FIG. 2 that panel strip 5 is wider than the forward directed panel strips 6 and 7, so that a V-shaped spaced results at the front of the panel element. This V-shaped space can be open, but can also be filled with light fittings, in which case the front surface between panel strips 6, 7 can be covered, for instance, with frosted glass or the like.

In the embodiment shown in FIGS. 1 and 2, panel strips 5, 6 and 7 are connected together by a moulding 8 which is made with eight continuous channels 9 (see also FIG. 3) which have an undercut form - in other words, end flanges 10 constrict the opening fo the channel inwards. Each panel strip 7 is provided near its edge 11 with two grooves 12 on opposing sides of the strip. The dimensions of connecting moulding 8 or the width of end flanges 10 is such that the long edges of flanges 10 fit into grooves 12. The connection is brought about by sliding moulding 8 and panel strips 5, 6 and 7 into eachother in the direction of arrow P1 in FIG. 3.

Moulding 8 also lends itself to the mounting of accessory elements, for example straight rod 11 or bent rods 12 and 13, which can be fastened in longitudinal channel 9 at the required height in any suitable manner. The means of fastening falls outside the scope of the invention and can be arbitrary in character.

Rod 11 or 12 can be used for the hanging up of articles of clothing, for instance, by means of the known clothes hangers.

Rod 13 can serve for the supporting of a shelf 3 for which no extra fastening means are necessary.

Although it is not necessary for the stability of the device, a backing wall 14 can be arranged on the side of the device opposite the open side, which can be connected to panel strip 5 by means of an appropriate longitudinal moulding 15 in the manner shown in FIG. 3. If required supporting rod 13 can be located in substantially situated holes in end wall 14, in order to obtain rear supporting of rod 13.

FIG. 4 shown an embodiment in which the point of departure is a standing panel unit 1 whereof strips 5', 6' and 7' are joined together as a unit, which can be brought about, for example, by applying an extrusion process to a suitable material, such as plastic.

The shelves 3 and/or transverse rods 11, 12 and 13 can be fastened in any manner to panel unit 1.

FIGS. 5 and 6 show an alternative embodiment of the connecting structure, wherein an edge of the panelstrip is provided with a longitudinal groove 12'. A connecting member 20 of suitable flexible material is provided with a body 21 able to be inserted into the undercut channel 9 of the mould 8. Owing to the flexibility of the body 21 insertion for mounting and removal for dismounting purposes can be done in the direction of arrow P2 and P3 respectively.

A rigid connection will be obtained since ribs 22 of body 21 are hooked underneath the flanges 10 of the mould. The body 21 is further provided with a longitudinal strip 23 having resilient ribs 24 which is to be inserted into said groove 12' of the panelstrip 5, 6 or 7, for a permanent fixation of the body 21 on the panel strip. Said body 21 can either extend over the fu ll length of the panel edge, or a plurality of short bodies can be spaced apart along the length of the panel.

The invention is not restricted to the above described embodiments. Although flexibility of the body 21 is enhanced by a hollow structure, the body 21 is not restricted to said structure. Further each standing panel unit 1 can also be made with only two panel strips 5, 6 or 5, 7. This embodiment is particularly suitable for the outer end panel units 1 of a storage/display device.

What is claimed is:

1. A storage and/or display device comprising the combination of first and second panel units spaced from one another to define a compartment therebetween, back wall means for bridging between the panel units, each of said panel units comprising at least three panels each of which has a body portion and opposite side edges, one side edge of each of said panels being adjacent to one another, channel means extending substantially continuously along said side edges of the panels connecting said adjacent side edges of the panels to one another thereby interconnecting the three panels of each unit with the body portions of the panels in angular relation to one another to define a substantially Y-shaped cross-section so that each panel unit is self-standing, one of the panels of each unit being substantially wider than the other two panels of the unit, said one of said panels being disposed substantially parallel to one another, and wherein each panel unit includes a horizontal support means extending between and engaged with said channel means and the back wall means for providing a horizontal support spaced from the first panel, and a shelf member fitted between the first panels and resting upon the horizontal support means.

2. A device as defined in claim 1 wherein said channel means is molding means in the form of a vertical member having a plurality of vertical channels disposed in angularly spaced relation therearound for receiving the adjacent vertical edges of the panels of a corresponding panel unit.

3. A device as defined in claim 1 wherein the shelf member being of hexagonal shape and extending from the back wall means and fitting between the first panels and the second panels.

4. A storage and/or display device comprising the combination of at least two load-bearing panel units and connecting means extending between the panel units for interconnecting them to define the storage and/or display device, each load-bearing panel unit comprising three vertical panels providing three adjacent vertical edges, molding means extending substantially continuously along said adjacent vertical edges for connecting the vertical edges in fixed, edge-adjacent relation, first panels of the two panel units being parallel, the first panel of each unit being wider than second and third panels thereof and the second and third panels of each panel unit being outwardly divergent from a respective first panel to define a Y-shaped self-standing and load bearing panel unit, the parallel first panels defining a vertically extending compartment therebetween, and a plurality of vertically spaced shelf members disposed in said compartment and fitting between said first panels.

5. A device as defined in claim 4 including a third panel unit identical to one of the two panel units and disposed with its first panel parallel to the first panels of the two panel units to define a second vertically extending compartment, and a plurality of vertically spaced shelf members disposed in said second compartment and fitting between said first panels between which the second compartment is defined.

6. A device as defined in claim 5 wherein said connecting means connects rear edges of the first panels.

7. A storage and/or display device comprising the combination of at least three load-bearing panel units, each of vertically extending Y-shaped configuration and the three panel units being disposed in horizontally spaced, parallel disposition to define two vertically extending compartments therebetween, each panel unit comprising first, second and third panels, the first panels of the three units being parallel and the first panel of each unit being wider than the second the third panels thereof and the second and third panels of each panel unit having side edges which are outwardly divergent from a side edge of a respective one panel to define a Y-shaped self-standing and load-bearing panel unit for each panel unit, and a plurality of vertically spaced shelf members disposed in each of said compartments and filling between said one panels.

* * * * *